US006851486B2

(12) United States Patent
Marshall

(10) Patent No.: US 6,851,486 B2
(45) Date of Patent: Feb. 8, 2005

(54) GRADING ATTACHMENT FOR A LOADER

(76) Inventor: Gerald Eugene Marshall, 1015 W. Main St., Monroe, WA (US) 98272

( * ) Notice: Subject to any disclaimer, the term of this patent is extended or adjusted under 35 U.S.C. 154(b) by 96 days.

(21) Appl. No.: 10/342,842

(22) Filed: Jan. 14, 2003

(65) Prior Publication Data

US 2003/0132014 A1 Jul. 17, 2003

Related U.S. Application Data

(60) Provisional application No. 60/348,556, filed on Jan. 15, 2002.

(51) Int. Cl.[7] ..... E02F 3/76
(52) U.S. Cl. ..... 172/792; 172/795
(58) Field of Search ..... 172/792, 793, 172/781, 789, 795–799

(56) References Cited

U.S. PATENT DOCUMENTS 2,698,491 A 1/1955 Felt
2,941,319 A 6/1960 Beemer et al.
3,470,967 A 10/1969 Page et al.
3,486,564 A 12/1969 Page et al.
3,598,186 A 8/1971 Coontz
4,081,033 A 3/1978 Bulger et al.
4,279,312 A * 7/1981 Pyle ..... 172/789
4,364,438 A * 12/1982 Pyle ..... 172/789
4,635,730 A 1/1987 Larsson
5,529,131 A 6/1996 Van Ornum
5,775,438 A 7/1998 Confoey et al.
6,168,348 B1 1/2001 Meyer et al.

* cited by examiner

*Primary Examiner*—Robert E. Pezzuto
*Assistant Examiner*—Alexandra K. Pechhold
(74) *Attorney, Agent, or Firm*—Dowrey Rickards PLLC

(57) ABSTRACT

A grading attachment for a skid steer loader is provided with steerable wheels that are steered by an actuator. The blade of the grading attachment may be rotatable through 360 degrees by a motor and gear assembly. Actuators may be provided to raise, lower and tilt the blade. The actuators may be hydraulic, and may be controlled by switches mounted on sleeves that may be mounted on the control handles of the loader. The switches may control the flow of hydraulic fluid to the actuators by actuating solenoid valves.

24 Claims, 7 Drawing Sheets

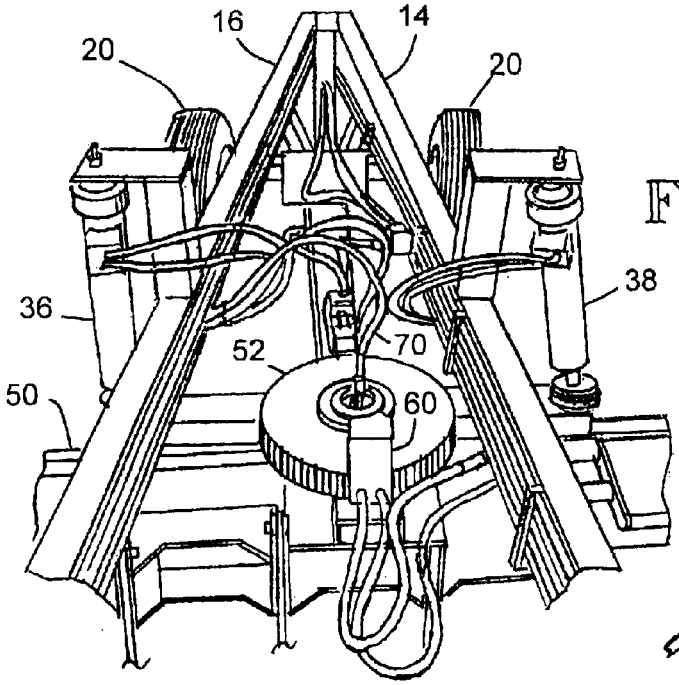
FIG. 4
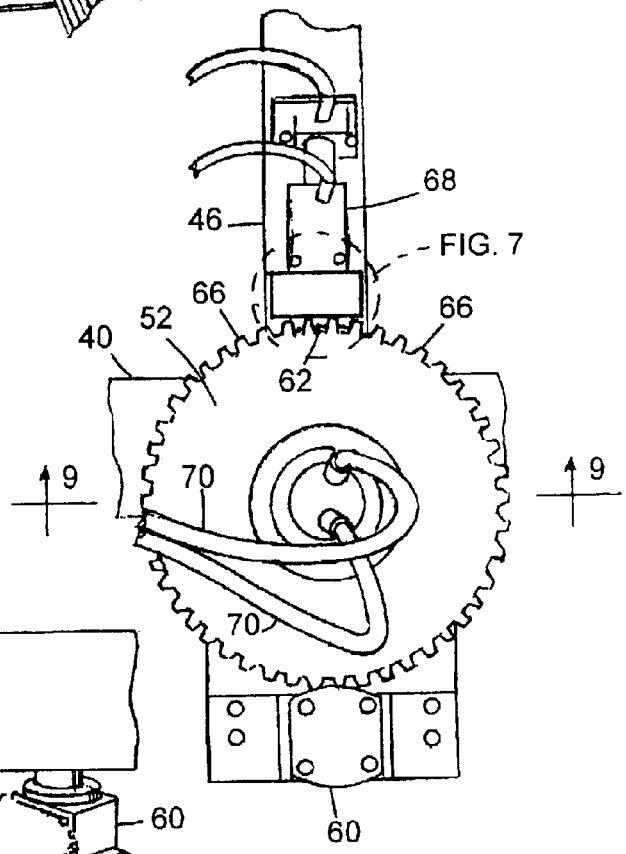
FIG. 5
FIG. 6
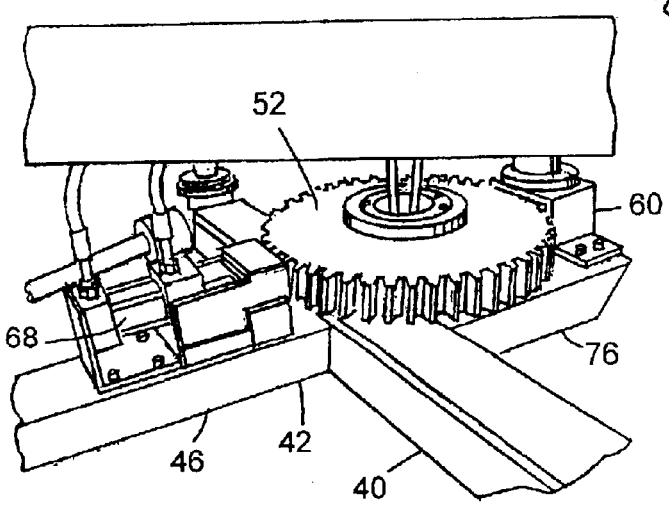

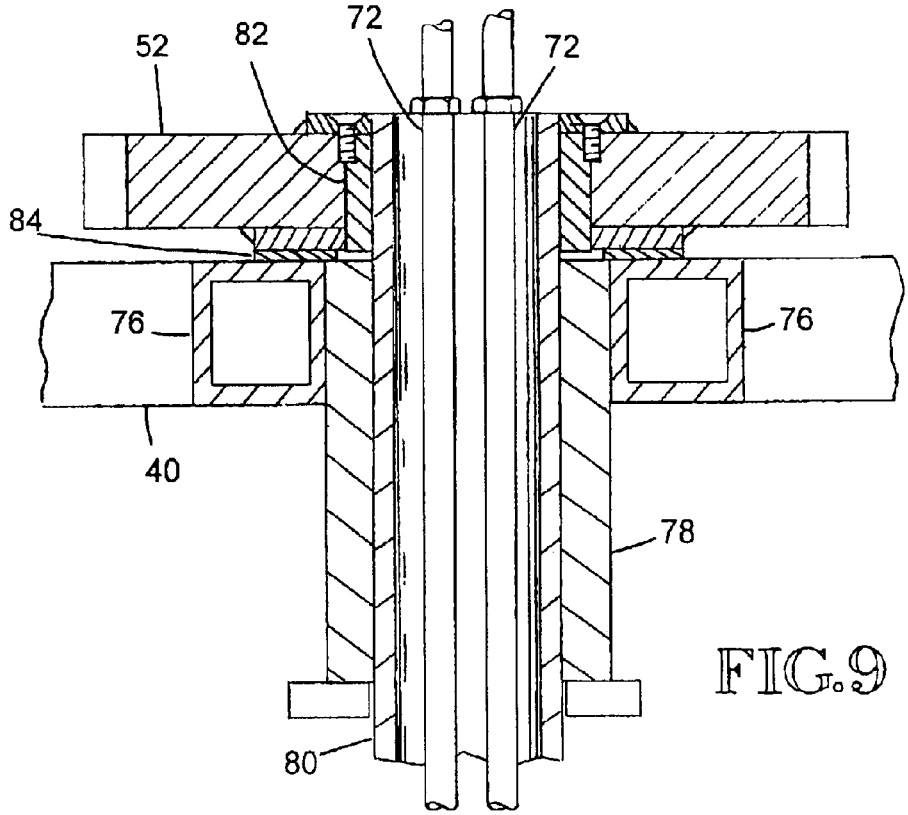
FIG. 9
FIG. 10
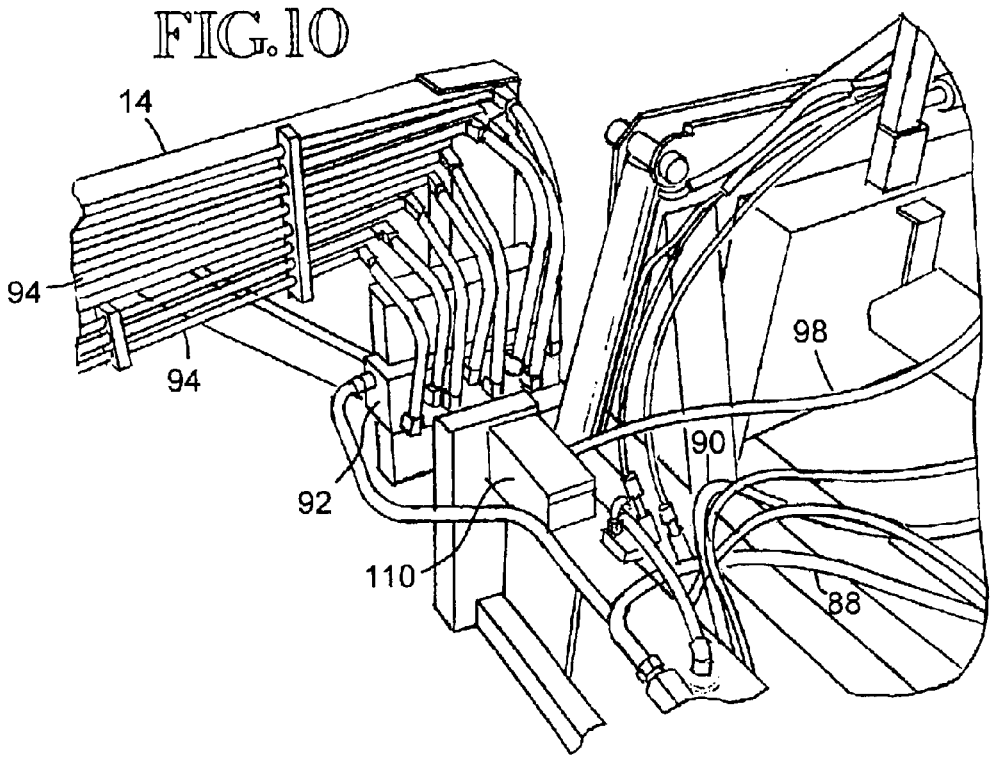

FIG. 11
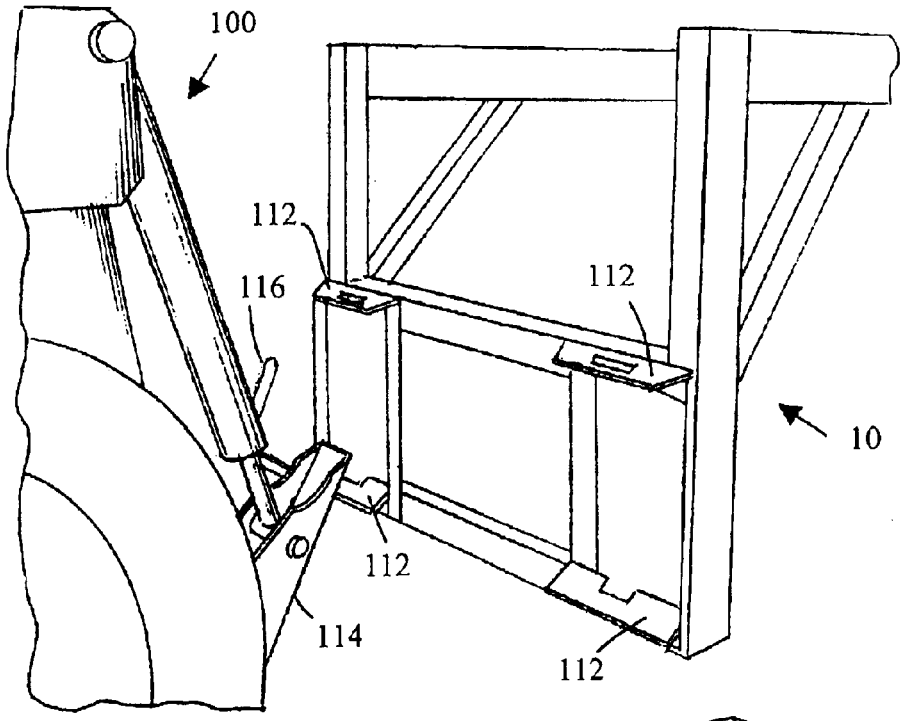
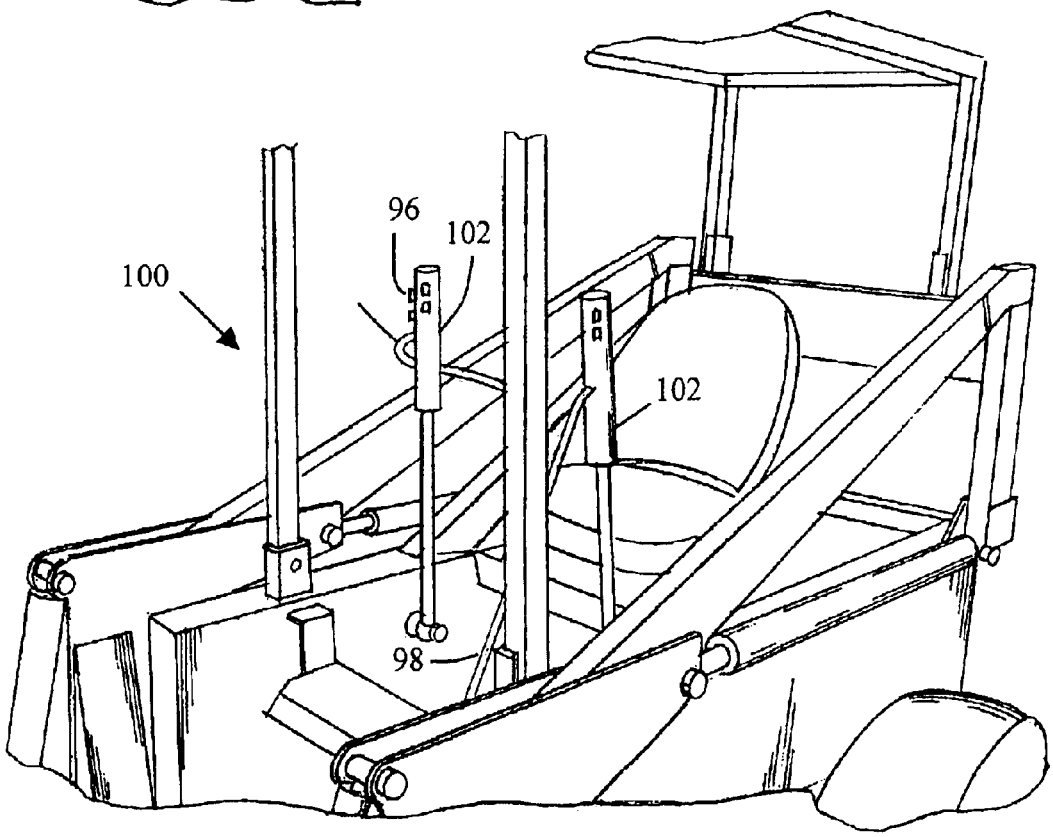
FIG. 12

GRADING ATTACHMENT FOR A LOADER

CROSS REFERENCE TO RELATED APPLICATIONS

This application claims the benefit under 35 U.S.C. 119 (e), of U.S. Provisional Patent Application Ser. No. 60/348,556 filed Jan. 15, 2002.

BACKGROUND OF THE INVENTION

1. Field of the Invention

The present invention relates, generally, to attachments for loader vehicles. More particularly, the invention relates to a grading attachment for a small loader vehicle, such as a BOBCAT or similar loader.

2. Background Information

Loaders, also known as skid steer loaders, are compact equipment widely owned by companies in the construction and other industries. Such loaders may be either wheeled or track vehicles. The movement of the loader is usually controlled by left and right control handles. Forward and reverse movement of the left and right control handles controls the forward and reverse speed of the left and right wheels, respectively.

As an example, if the left control handle is moved forward farther than the right control handle, more power is provided to the left wheels or track than to the right wheels or track, and the loader will turn to the right. If the left control handle is moved forward and the right control handle is moved back, the wheels or tracks on opposite sides of the loader will rotate in opposite directions, the loader may turn about its vertical axis. Of course, as the wheels are not steered to make such turns, some skidding of the wheels results as the loader is turned.

The state of the art includes various graders and grader attachments for vehicles.

U.S. Pat. No. 5,529,131 to Van Ornum discloses a grading attachment for a loader having a pair of wheels at its front, and a hydraulically actuated blade that pivots about a vertical axis. Since the blade is rotated by means of hydraulic cylinder connected to a mounting plate, the blade cannot rotate all the way around to grade in reverse.

U.S. Pat. No. 4,635,730 to Larsson discloses a hydraulically actuated blade control mechanism which allows the blade to swing transversely and pivot, but again, because of hydraulic linkages it does not appear that the blade could rotate completely around to be able to grade in reverse.

Both of these attachments have front wheels to support their weight, but those wheels are not steerable. Steering of the Van Ornum and Larsson grading attachments is accomplished through the steering of the loader, which is done by the loader's traction wheels. With the extended length of the grading attachment, such steering typically requires greater torque on the traction wheels. It is likely that there will be slippage between the traction wheels and the newly graded surface over which they are operating, thereby tearing up the newly graded surface.

U.S. Pat. No. 6,168,348 to Meyer et al. also discloses a surface leveling system that can be attached to a loader, and it too has non-steerable front wheels.

U.S. Pat. No. 5,775,438 to Confoey et al. discloses a scraping device for attaching to a loader, but it has no front wheels to support it.

U.S. Pat. No. 3,598,186 to Coontz discloses a grading blade for attachment to a tractor that has a hydraulically-actuated blade rotation mechanism, but the device hangs off of the back of a tractor and has no supporting wheels.

Steerable wheels are found on conventional graders such as those disclosed in U.S. Pat. No. 4,081,033 to Bulger et al. and U.S. Pat. No. 3,486,564 to Page et al., but those wheels are steered mechanically, and such mechanical arrangements are not suited for a device to be attached to a loader.

BRIEF DESCRIPTION OF THE INVENTION

In one aspect, the present invention provides a grading attachment for a loader with steerable front wheels. In another aspect, the blade is laterally and horizontally positionable and rotatable relative to the frame of a grading attachment by hydraulic actuators or other actuators. In another aspect of the invention, the actuators are controlled by electric switches mounted on controllers that are in turn mountable on the control handles of a loader. The switches may operate the hydraulic actuators by controlling solenoid valves that, in turn, control the flow of hydraulic fluid to the actuators. In another aspect of the invention, the blade is rotatable about its vertical axis through 360 degrees.

BRIEF DESCRIPTION OF THE DRAWINGS

FIG. 4 is a perspective view of the grader attachment of FIG. 1 from above with parts broken away showing the mechanism for pivoting the blade and the hydraulic lines.

FIG. 5 is a top plan view of the blade pivoting mechanism of FIG. 4.

FIG. 6 is a perspective view of the blade pivoting mechanism of FIG. 5.

FIG. 9 is a cross-sectional view taken along line 9—9 of FIG. 5.

FIG. 10 is a perspective view of a rear portion of the grader attachment showing the hose arrangement for the hydraulic controls.

FIG. 11 is a perspective view of a rear portion of the grader attachment showing a mechanism for connecting the grader attachment to a lifting member of a loader.

FIG. 12 is a perspective view of a loader showing the control handles with switches for controlling the hydraulics of the grader attachment.

DETAILED DESCRIPTION

Figure 1:
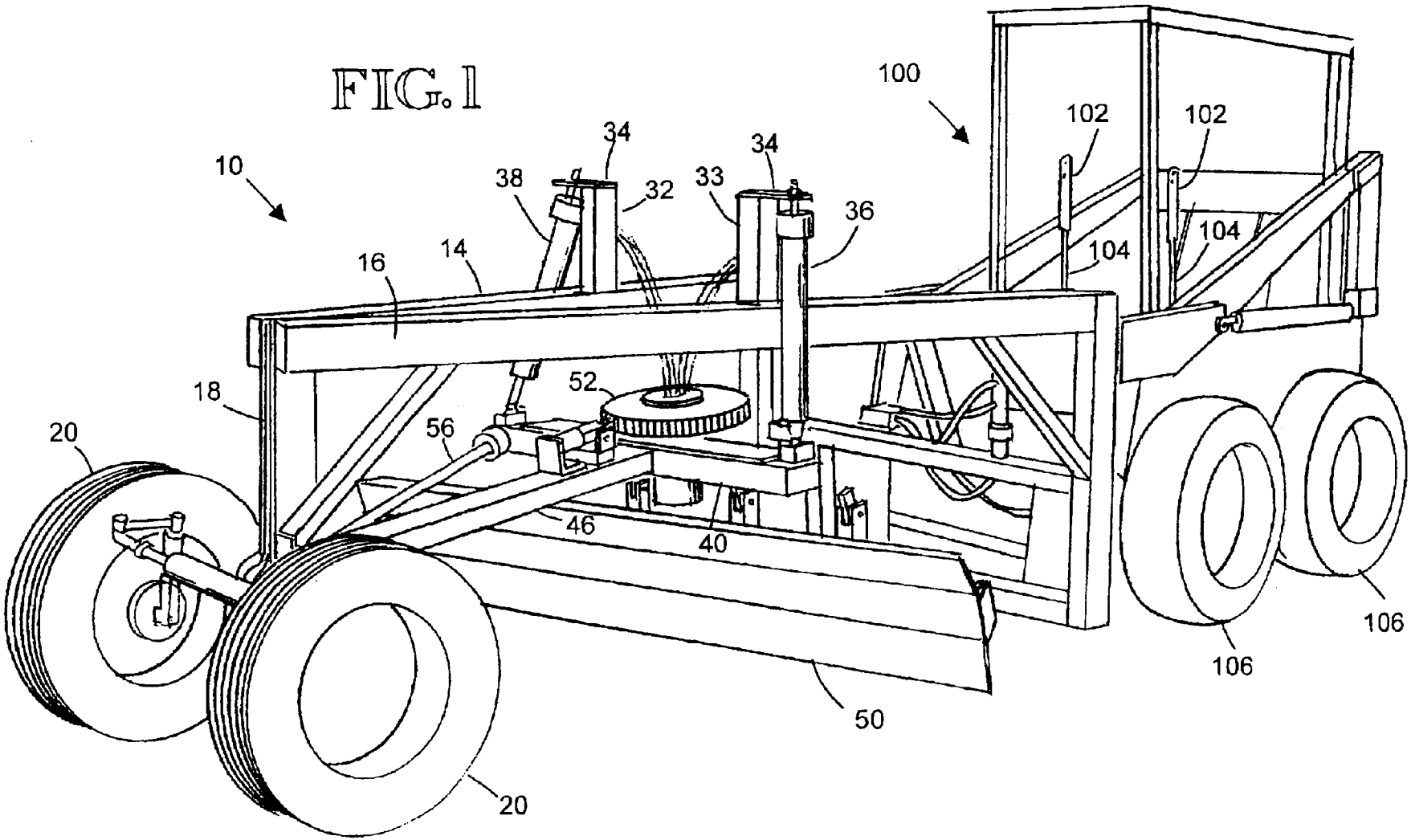
FIG. 1 is a perspective view of a grader attachment of the present invention shown attached to a loader vehicle.

FIG. 1 depicts an example of a preferred embodiment of the present invention, generally illustrated and indicated by the reference numeral 10. The grader attachment 10 is shown attached to a small loader 100, such as a BOBCAT™ or similar vehicle. The grader attachment 10 has hydraulically steerable front wheels 20, and a blade 50 that can be moved vertically and laterally, can be tilted, and can be rotated through 360 degrees by numerous hydraulic devices. This enables grading to be done in reverse as well as in the forward direction. If ripping bars 58 or other implements are attached to the back of the blade, the blade may also be rotated such that the reverse side of the blade 50 is facing generally forward so that the implements may be used as the loader and grading attachment move forward.

Control of the various hydraulic devices is accomplished through a plurality of solenoid valves actuated by a plurality of button switches on sleeves 102 that slip over control handles 104 on the loader 100. Hydraulic power for all the devices on the grader attachment 10 may be taken from a single auxiliary hydraulic power outlet on the loader.

Figure 2:
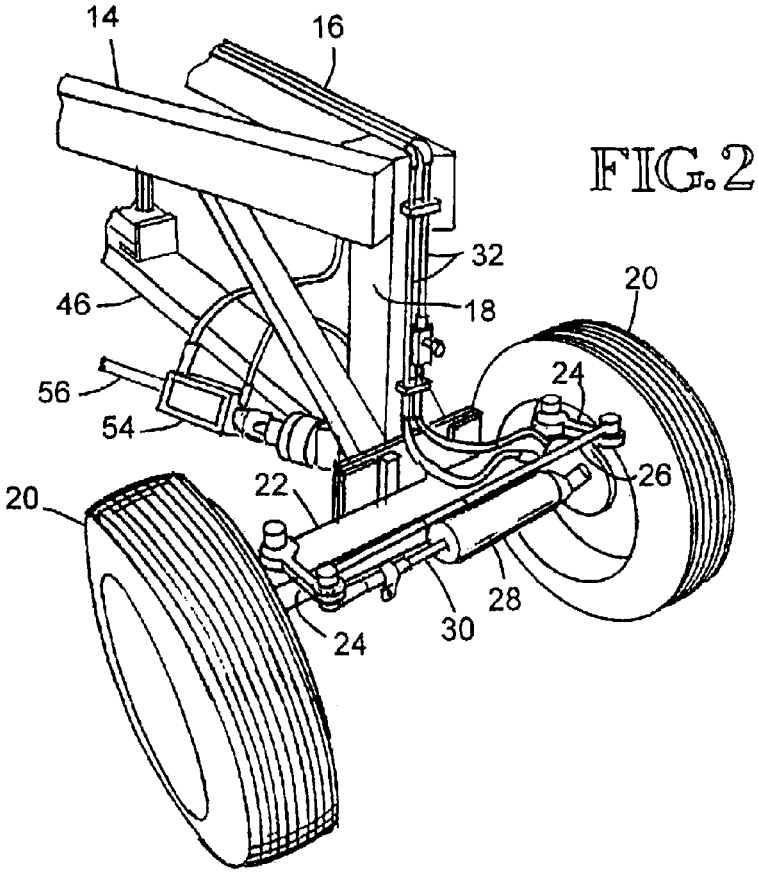
FIG. 2 is a perspective view of the front portion of the grader attachment of FIG. 1 showing the steerable front wheels.

Referring to FIGS. 1 and 2, grader attachment 10 has a frame, preferably made of structural steel rectangular tubing members welded together. The frame preferably has two longitudinal members 14, 16 arranged in a "V" shape with the apex of the "V" at the front. The operator has good visibility of the blade and pivoting mechanism through the wide part of the "V" during grading operation. The front ends of longitudinal members 14 and 16 are welded to a vertical member 18 to which a cross member 22 attaches at its bottom. The cross member may be pivotably connected to the frame such that it is rotatable from a horizontal orientation.

Steerable front wheels 20 are pivotably attached to each end of the cross member 22 with a control arm 24 for each wheel and a tie rod 26 connected between the control arms 24. Toe-in of wheels 20 can be adjusted by the tie rod 26. A steering actuator, such as hydraulic cylinder 28 is attached to cross member 22 and has its piston arm 30 connected to one of the control arms 24. The hydraulic cylinder 28, control arms 24 and tie rod 26 comprise a steering system for the grading attachment.

The hydraulic lines 32 for controlling cylinder 28 are preferably routed along vertical member 18 and frame longitudinal member 16. In the embodiment shown, as hydraulic cylinder 28 is activated to extend piston arm 30, the wheels 20 are pivoted to turn right. When the cylinder 28 is actuated to retract piston arm 30, the wheels 20 are pivoted to turn left.

The advantage of having steerable wheels 20 on grader attachment 10 is that the drive wheels 106 on the loader 100 do not have to be used for steering during grading operations. As such, the need to apply differential torque to the drive wheels 106 may be reduced or eliminated. Such differential torque may result in slippage between the traction wheels and the newly graded surface over which they are operating, thereby tearing up the newly graded surface. Of course, if the blade 50 is positioned at an angle with respect to the long axis of the frame of the grading attachment 10, and if the grading process generates significant lateral loads on the blade 50, it may be desirable to apply differential power to the wheels of the loader as well as to steer using the steerable wheels of the grading attachment.

Should the grader attachment 10 and the loader need to be tuned around in a short distance, the entire grader attachment can be lifted off the ground by the loader and tipped toward the vertical so that the loader drive wheels 106 can then steer the loader in a normal manner.

Figure 3:
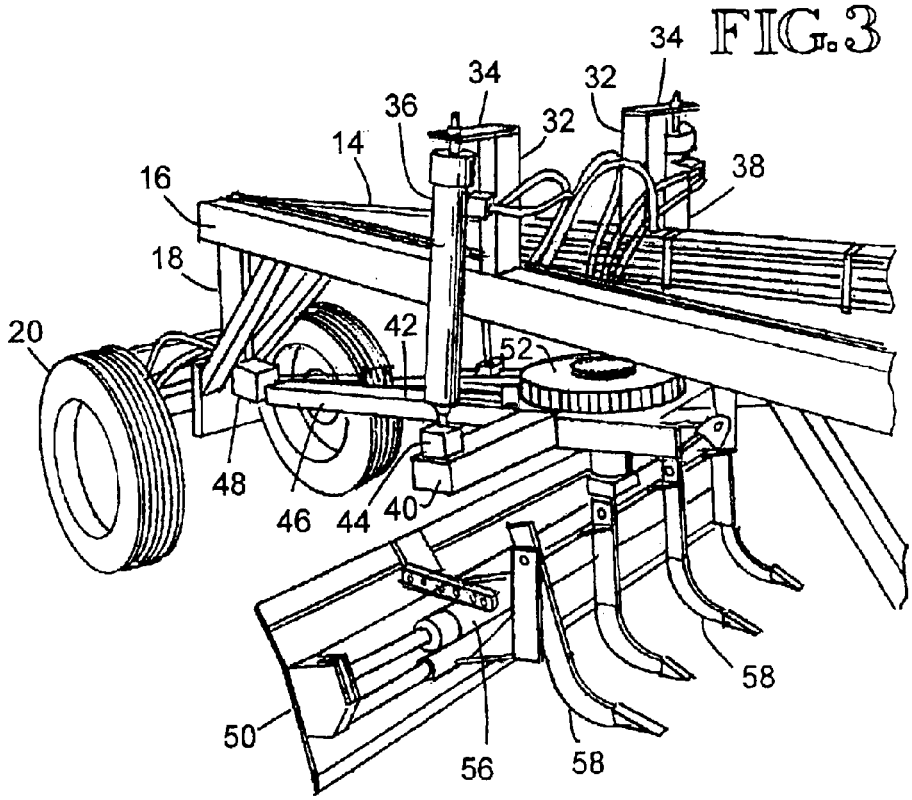
FIG. 3 is a perspective view of the grader attachment of FIG. 1 with parts broken away showing the back of the blade.
Figure 7:
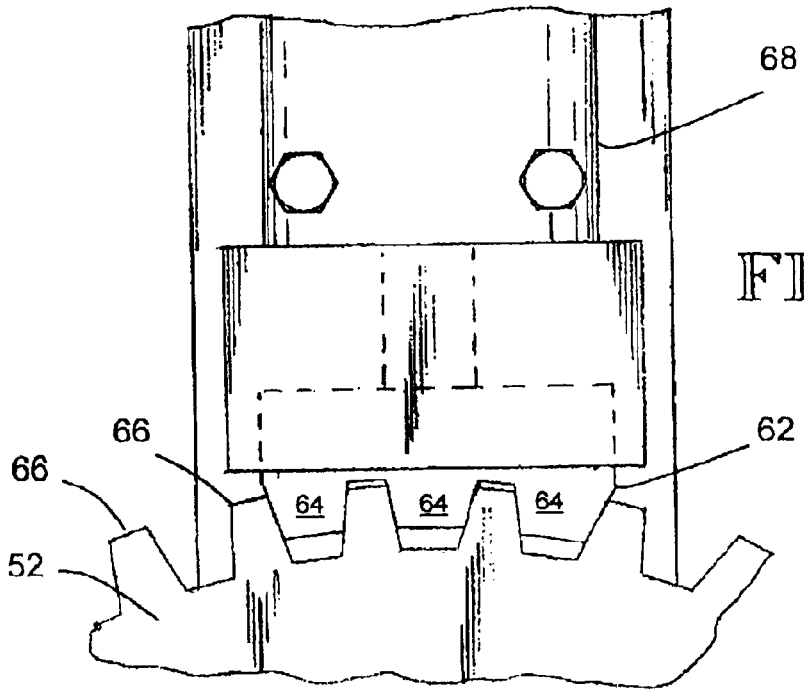
FIG. 7 is a detailed view of a portion of the blade pivoting mechanism of FIG. 5 showing the locking member engaged with the gear.
Figure 8:
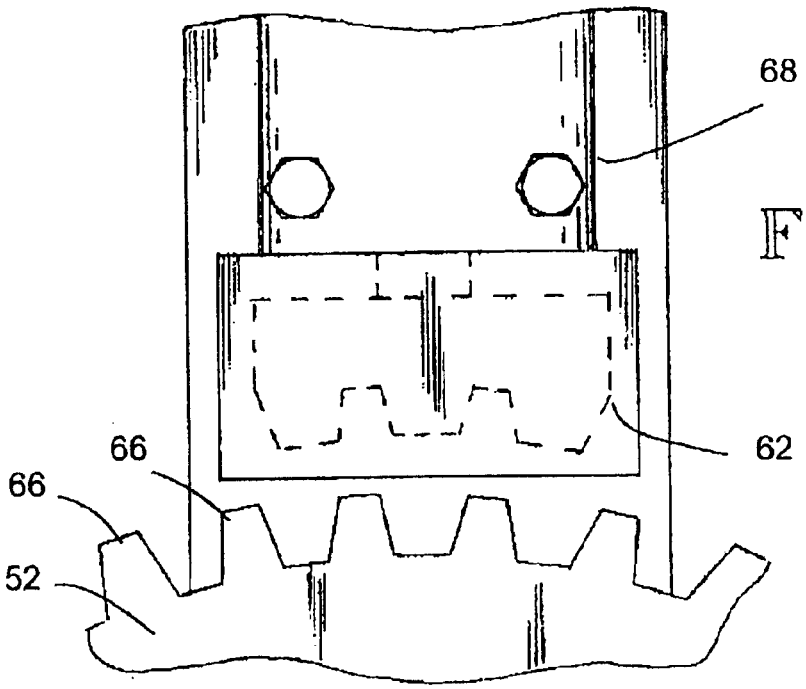
FIG. 8 is a detailed view of a portion of the blade pivoting mechanism of FIG. 5 showing the locking member disengaged from the gear.

Referring to FIG. 3, the blade is supported by the components of the grading blade assembly. More particularly, in the present embodiment, the blade 50 is supported by blade mount longitudinal members 14 and 16 each having a vertical member 32 extending upward approximately from their middle. A pair of blade positioning actuators, such as hydraulic cylinders 36 and 38, connect to a plate 34 at the top of each vertical member 32 and to a transverse member 40 of the blade lifting arm 42 at ball joints 44. The blade lifting arm 42 also has a longitudinal member 46 that extends forward and connects to vertical member 18 with a ball joint 48. Blade 50 is connected to blade lifting arm 42 below it and pivots a full 360 degrees, preferably by means of the pivoting gear 52. Hydraulic cylinders 36 and 38 raise and lower blade 50 and tilt it. The entire lifting arm 42 can also be shifted transversely by a traversing actuator, hydraulic cylinder 54, which extends and retracts arm 56 connected between transverse member 40 of lifting arm 42 and vertical member 18 of the frame. Blade 50 can also be moved transversely by a blade shifting actuator, such as hydraulic cylinder 56. With all these adjustments possible, the blade can be placed in practically any desired position for grading forward or backward. Ripping bars 58 are preferably pivotally attached to the back of blade 50 and can be selectively raised or lowered to perform a ripping function when the blade 50 is moved backward. This may be accomplished, for example, by rotating the blade 180 degrees so that the front of the blade is facing the loader, positioning the ripping bars to the desired position, and then driving the loader 100 forward.

Referring to FIGS. 4–8, the blade 50 is suspended from the lifting arm 42 through a pivoting connection to which pivoting gear 52 is attached. Pivoting gear 52 is driven by a pinion gear (not shown) rotated about a vertical axis by a reversible high-torque low-speed hydraulic motor 60, such as Parker number 110A-164-AS-0 mounted on lifting arm 42. To lock the position of pivoting gear 52 and to react the torque load on it from the blade 50, locking member 62 is engagable with gear 52. Locking member 62 has preferably three teeth 64 that engage the teeth 66 of pivoting gear 52. An actuator such as hydraulic cylinder 68 moves locking member 62 into or out of engagement with gear 52 to selectively engage or disengage teeth 66 of gear 52. When locking member 62 is disengaged from gear 52, gear 52 can be freely rotated by hydraulic motor 60 with the pinion gear engaged with teeth 66 of gear 52. When locking member 62 is engaged with gear 52, it reacts the torque load from the blade 50 rather than that function being required of hydraulic motor 60.

Referring to FIGS. 5 and 9, the pivoting connection for pivoting gear 52 provides a pass-through connection for hydraulic lines 70 that connect to hydraulic cylinder 56. Hydraulic lines 70 are flexible and connect to rigid lines 72 that extend through the pivoting connection. As pivoting gear 52 rotates, the rigid lines 72 move with it and hydraulic lines 70 will become twisted as gear 52 rotates. Once the gear 52 has been rotated 360 degrees about a vertical axis, to continue rotating, it is preferable to first unwind the twisted hydraulic lines 70 by rotating the gear 52 back one revolution.

One embodiment of a mechanism for pivoting the blade 50 is illustrated in FIG. 9. Transverse member 40 of lifting arm 42 preferably has a pair of longitudinal stub members 76 attached, such as by welding, in spaced parallel arrangement with a space between them that receives a cylinder 78 which is attached to transverse member 40 and stub members 76, such as by welding. Cylinder 78 is oriented vertically and has a bore which receives cylindrical shaft 80 which is of a diameter such that it will readily rotate within cylinder 78.

Gear 52 has a bore that fits over shaft 80 and is connected to the upper portion of cylinder 80, preferably by means of a taper-lock 82 installed between the bore of gear 52 and the outside of shaft 80. A thrust plate 84 or other such functioning bearing is installed between gear 52 and members 40 and 76. The lower portion of shaft 80 is connected to blade 50. As gear 52 is driven by the pinion gear on motor 60, it rotates shaft 80 which turns within cylinder 78 and pivots blade 50.

Other mechanisms for pivoting blade 50 may include any well-known drive mechanisms such as a sprocket and chain or a worm gear arrangement rather than the gear and pinion mechanism illustrated.

Referring to FIG. 10, the mechanisms for controlling the blade position and the steering of the grader attachment 10 are all preferably hydraulically actuated, although other types of actuators may be used. Hydraulic power for all the actuators preferably comes from the hydraulic take-off of the loader 100.

A single hydraulic input line 88 and a single hydraulic outlet line 90 are connected to the hydraulic take-off connections of loader 100. The inlet line 88 is routed to the inlet of an array of hydraulic solenoid valves 92 arranged to function in parallel, and preferably mounted near the back of grader attachment 10. The array of solenoid valves 92 can be divided into two or more groups with one group mounted near longitudinal member 14 as illustrated, and another similar group mounted near longitudinal member 16. Tubing 94 moving hydraulic fluid between valves 90 and the various hydraulic actuators is preferably routed along longitudinal members 14 and 16. Each solenoid valve 92 is preferably a four-way control valve with open center, such as Parker number MD06-SNDC-AD-12B.

Figure 13:
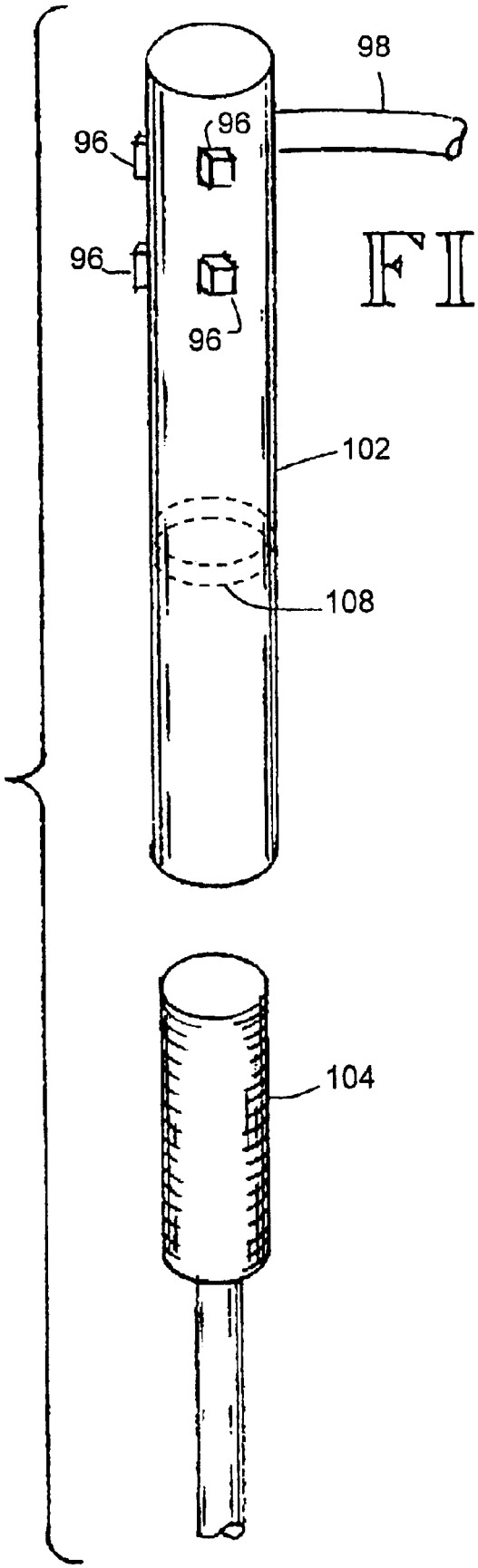
FIG. 13 is an exploded perspective view of one of the control handles shown removed from the associated control lever of the loader.

Referring to FIGS. 10, 12 and 13, each solenoid valve 92 is actuated by a separate electrical switch 96 mounted on one of a pair of sleeves or stalks 102, which, in the present embodiment are tubular members that slip over control handles 104 on the loader 100. Sleeve 102 has a stop, such as disk 108, installed inside of it. The stop rests against the top of handle 104 when the sleeve is installed on handle 104 so that the handle 104 does not interfere with switches 96 or the wires connected to them. The wires connected to the switches 96 are bundled into a cable 98 and runs from each sleeve 102 to a junction box 110 mounted on the grader attachment 10 which then connects the appropriate wires to the appropriate valve 92. Switches 96 are preferably push-button type switches, but also may be toggle or any other desired type of switch.

Referring to FIG. 11, the back of grader attachment 10 has conventional attachment features 112 for connecting to the lifting mechanism 114 of loader 100. A locking bar 116 is pivotally attached to the lifting mechanism 114 and engages the attachment features 112 in a conventional manner to secure grader attachment 10 to loader 100.

The present invention provides a grader attachment for a loader with steerable front wheels and a blade that can be pivoted 360 degrees as well as lifted, tilted and slid sideways to allow precise grading, both forward and backward, including grading of narrow spaces, such as sidewalks, paths and driveways. The steerable front wheels can reduce or eliminate the need to use differential torque on the loader's wheels for steering, which otherwise might disturb the freshly graded surface.

While the present application discusses embodiments of the invention including hydraulic actuators, such as hydraulic cylinders and motors, other types of actuators may be used. For example, a recirculating ball screw driven by a hydraulic, electric or pneumatic motor might be used in place of a hydraulic cylinder.

The descriptions above and the accompanying drawings should be interpreted as illustrative and not as limiting the scope of the invention. While the invention has been disclosed in connection with the preferred embodiment or embodiments thereof, it should be understood that other embodiments may be devised by those skilled in the art that fall within the scope of the invention. While the present invention has been described with reference to several embodiments thereof, those skilled in the art will recognize various changes that may be made without departing from the spirit and scope of the claimed invention. Accordingly, this invention is not limited to what is shown in the drawings and described in the specification but rather as indicated in the appended claims.

What is claimed is:

1. An unpowered grading attachment for a skid steer loader, said loader including lifting apparatus, the attachment comprising:

a frame mountable to the lifting apparatus of a loader adjacent a first position on the frame;

a steering system mounted to the frame adjacent a second position on the frame remote from the first position, the steering system comprising at least one wheel rotatably and pivotably mounted on the frame and a steering actuator acting between the frame and the wheel for steering the wheel;

a blade assembly mounted to the frame intermediate the first and second locations on the frame; and a controller including a steering control mounted thereto for controlling the actuator to steer the at least one wheel, the control being operable by an operator in the cab of a loader to which the grading attachment has been mounted.

2. The grading attachment of claim 1 wherein the first position on the frame is adjacent a first end of the frame and wherein the second position on the frame is adjacent a second end of the frame, and wherein the attachment is liftable by the lifting apparatus of the loader.

3. The grading attachment of claim 2 wherein the at least one steerable wheel comprises two wheels pivotably mounted to the frame and connected by a steering linkage such that the two wheels can be simultaneously steered by the actuator.

4. The grading attachment of claim 3 wherein the steering actuator is a hydraulic cylinder, and wherein the actuator is connected to the steering linkage.

5. The grading attachment of claim 1 wherein the grading blade assembly comprises:

a blade lifting arm pivotably connected to the frame;

a blade rotatably connected to the blade lifting arm;

a blade actuator connected to the blade lifting arm for rotating the blade about a vertical axis; and a blade lifting arm actuator system for positioning the blade relative to the frame.

6. The grading attachment of claim 5 further comprising at least one blade control mounted on the controller for controlling rotation of the blade.

7. The grading attachment of claim 6 further comprising at least one blade positioning control mounted on the controller for controlling positioning of the blade relative to the frame.

8. The grading attachment of claim 5 wherein the blade lifting arm comprises:

a longitudinal member pivotably mounted at one end thereof to the frame proximate to the second end of the frame such that the other end of the longitudinal member may be pivoted relative to the frame in both horizontal and vertical directions; and a transverse member mounted to the longitudinal member at a location remote from the one end of the longitudinal member, and extending away from the longitudinal member on both sides of the longitudinal member.

9. The grading attachment of claim 8 wherein the blade lifting arm actuator assembly further comprises:

at least two blade positioning actuators pivotably connected between the frame and the transverse member, such actuators being connected to the transverse member at locations on opposite sides of and spaced apart from the longitudinal member; and a traversing actuator pivotably connected between the frame and the blade lifting arm for positioning the longitudinal member relative to the frame.

10. The grading attachment of claim 8 wherein the blade actuator comprises a hydraulic motor connected to the blade lifting arm and a gear connected to the blade and rotatable by the hydraulic motor to rotate the blade about its axis.

11. The grading attachment of claim 10 further comprising a control mounted on the controller for controlling rotation of the blade by the hydraulic motor.

12. The grading attachment of claim 10 wherein the blade lifting arm further comprises a gear locking member movable into and out of engagement with the gear to selectively permit and restrict rotation of the gear.

13. The grading attachment of claim 9 wherein the blade positioning actuators and the traversing actuator comprise hydraulic cylinders, and wherein the controller further comprises controls mounted thereon for controlling operation of the hydraulic cylinders.

14. The grading attachment of claim 8 wherein the longitudinal member is connected to the frame at its one end by a ball joint.

15. The grading attachment of claim 5 wherein the steering actuator comprises a hydraulic cylinder, wherein the blade mount actuator system comprises a plurality of hydraulic cylinders and wherein the blade actuator comprises a hydraulic motor, and wherein the grading attachment further comprises a plurality of controls mounted on the controller for controlling the steering actuator, the plurality of hydraulic cylinders and the hydraulic motor, said controls comprising electrical switches connected to a plurality of electrically-operated hydraulic valves for controlling the flow of hydraulic fluid to the steering actuator, the blade lifting arm actuator system and the hydraulic motor.

16. The grading attachment of claim 1 wherein the controller comprises right and left control stalks mountable respectively on the right and left control handles of a loader.

17. The grading attachment of claim 16 wherein the frame comprises a cross member pivotably mounted to the second end thereof, wherein the at least one wheel comprises two wheels respectively pivotably and rotatably mounted adjacent opposite ends of the cross member.

18. The grading system of claim 5 wherein the steering actuator, the blade positioning actuators and the traversing actuators comprise hydraulic cylinders and wherein the blade actuator comprises a hydraulic motor, and further comprising an actuator control system, the actuator control system comprising:

left and right control stalks mountable on left and right control handles of a loader;

a plurality of electrical switches mounted on the control stalks and connected, respectively, to a plurality of solenoid valves for controlling the flow of hydraulic fluid to the steering actuator, the blade positioning actuators, the traversing actuator and the blade positioning actuator.

19. The grading attachment of claim 1 wherein the steering actuator comprises a hydraulic cylinder operated by at least one solenoid valve, wherein the steering control comprises an electrical switch connected to the solenoid valve, and wherein the controller is mountable on the control handle of a loader.

20. The grading attachment of claim 5 wherein the blade is slidably mounted to the lifting arm.

21. An unpowered grading attachment for a skid steer loader comprising:

a frame having first and second ends, the frame being mountable adjacent its first end to the lifting apparatus of a loader;

two steerable wheels pivotably and rotatably mounted adjacent the second end of the grader attachment and steerable by a hydraulic actuator;

an elongated blade lifting arm having a first end, the first end being pivotably connected to the frame adjacent the second end of the frame;

a blade rotatably mounted to the lifting arm at a position remote from the first end of the lifting arm;

an actuator system for raising, lowering and tilting the blade; and an actuator for rotating the blade through 360 degrees.

22. The grading attachment of claim 21 further comprising a control system for controlling the hydraulic actuator to steer the grading attachment, the control system comprising first and second control sleeves mountable, respectively, on left and right control handles of a loader, the control sleeves further comprising left and right controls for positioning the hydraulic actuator to steer the grading attachment.

23. The grading attachment of claim 21 wherein the first and second control sleeves comprise at least one control mounted on each of the first and second control sleeves for controlling the actuator system for raising, lowering and tilting the blade.

24. The grading attachment of claim 21 wherein the first and second control sleeves comprise at least one control mounted on each of the first and second control sleeves for controlling the actuator for rotating the blade.

* * * * *